US007377074B2

(12) United States Patent
Marocco

(10) Patent No.: US 7,377,074 B2
(45) Date of Patent: May 27, 2008

(54) PULL BAR CONNECTOR FOR SHUTTERS

(75) Inventor: Norbert Marocco, 46 Pennycross Court, Woodbridge (CA) M4L 3M6

(73) Assignee: Norbert Marocco, Woodbridge, Ontario (CA)

( * ) Notice: Subject to any disclaimer, the term of this patent is extended or adjusted under 35 U.S.C. 154(b) by 0 days.

(21) Appl. No.: 10/214,835

(22) Filed: Aug. 8, 2002

(65) Prior Publication Data

US 2004/0025438 A1 Feb. 12, 2004

(51) Int. Cl.
*E06B 7/86* (2006.01)

(52) U.S. Cl. ..... 49/87.1; 49/74.1

(58) Field of Classification Search ..... 49/74.1, 49/73.1, 25, 87.1, 371, 82.1
See application file for complete search history.

(56) References Cited

U.S. PATENT DOCUMENTS

| | | | | | |
|---|---|---|---|---|---|
| 479,398 | A * | 7/1892 | Buhmeier | 49/80.1 |
| 2,761,185 | A * | 9/1956 | Sherwood | 49/74.1 |
| 4,103,601 | A * | 8/1978 | Dayus | 454/319 |
| 4,996,793 | A * | 3/1991 | Mazur | 49/74.1 |
| 5,064,227 | A * | 11/1991 | Spors et al. | 285/319 |
| 5,159,783 | A * | 11/1992 | Rossiter | 49/403 |
| 5,187,896 | A * | 2/1993 | Ross | 49/74.1 |
| 5,303,507 | A * | 4/1994 | Oille | 49/74.1 |
| 5,392,561 | A * | 2/1995 | Henley, Sr. | 49/74.1 |
| 5,548,925 | A | 8/1996 | Marocco | |
| 5,598,664 | A * | 2/1997 | Grice | 49/74.1 |
| 5,732,507 | A * | 3/1998 | Edwards | 49/74.1 |
| 5,921,028 | A | 7/1999 | Marocco | |
| 6,041,547 | A | 3/2000 | Marocco | |
| 6,250,012 | B1 * | 6/2001 | Ricci | 49/87.1 |
| 6,263,632 | B1 * | 7/2001 | Cadorette | 52/473 |
| 6,266,923 | B1 | 7/2001 | Lee | |
| 6,401,391 | B2 * | 6/2002 | Gabriele | 49/87.1 |
| 6,453,972 | B1 * | 9/2002 | Sher et al. | 160/133 |
| 6,510,655 | B1 * | 1/2003 | Antonini | 49/87.1 |
| 6,602,014 | B2 * | 8/2003 | Lee | 403/68 |
| 6,622,433 | B2 * | 9/2003 | Blachley | 49/506 |
| 6,675,534 | B2 * | 1/2004 | Marocco | 49/86.1 |
| 6,732,475 | B1 * | 5/2004 | Lee | 49/505 |

* cited by examiner

*Primary Examiner*—Jerry Redman
(74) *Attorney, Agent, or Firm*—Ohlandt, Greeley, Ruggiero & Perle, LLP

(57) ABSTRACT

A shutter having a frame and rotatable louvres of the type having a control rod connected to the louvres for moving said louvres, and having a control rod extending normal to the louvres, spaced apart from the louvres connector members on the louvres, having hinge formations extending outwardly from respective louvres, and having connector members for the control rod, having hinge formations and in which the hinge formations provide a hinge connection between the louvres and the control rod, with hinge axes spaced between the louvres and the control rod, and locating the control rod at a distance from the louvres sufficient to permit the louvres to be fully closed by the control rod without the control rod contacting the louvres.

18 Claims, 6 Drawing Sheets

PULL BAR CONNECTOR FOR SHUTTERS

FIELD OF THE INVENTION

The invention relates to shutters of the type having horizontal louvres or blades, in which the louvres are joined together by a pull bar. In particular the invention relates to a connector system for linking the pull bar to the louvres.

BACKGROUND OF THE INVENTION

Shutters having horizontal louvres or blades adjustably movable, by tilting upwardly or downwardly between open and closed positions are well known in the art. Shutters utilizing a control bar attached to the louvres or blades for facilitating the opening and closing of the louvres are also well known.

In the past methods of attaching a control bar to each louver or blade have included simple wood fastenings such as screw eyelets and wire hooks, or even a pair of linked staples, in many cases. The eyelets or staples were fastened in the louvre or the control rod and were looped together. The hooks, eyelets or staples were linked together to provide a crude somewhat loose hinge link.

This staple system has been in use up to the present time. For example such a staple connector system is shown in U.S. Pat. No. 6,266,923 B1 Jul. 31, 2001, H S Lee.

This staple connector system had several disadvantages. While this system allowed for some degree of simultaneous movement of the louvres, it did not move the louvres uniformly. There was a considerable amount of slack between the control rod and the louvres, which caused a staggered movement of the louvres as the slack was taken up on each louvre. There was no defined location for the pivot axis of the connectors. The degree of slack meant that, when closing the louvres, the pivot axis of each connector moved inwardly, up against the edge of the louvre. Shutters in which the control bar is loosely connected to the louvres have a further disadvantage. To accomplish complete shutting of the louvres using this system, due to the slack and the sloppy movement of the connectors, the control rod had to be pushed up against the edges of the louvres or blades to ensure complete closure. This required recesses to be routed in the frame of the shutter to accommodate the control rod. Such recesses are shown in the above noted U.S. Pat. No. 6,266,923 B1. Routing of rod receiving recesses in the top and bottom frames was a costly process in both skilled labour and equipment. It was suitable in general, only for shutters having wooden components. In addition, over time and use, the control rod fastenings would loosen in the wood and sometimes fall out.

U.S. Pat. No. 5,187,896 February 1993 issued to Ross shows a form of connection system for connecting a pull bar to hollow plastic louvres. This system was time consuming to assemble, and required maintenance if the parts failed. In addition there was some free play or slack built in to the system where the connectors nested in the interior of the louvres. There was no defined pivot axis, which was maintained at all times. The end of the single link extended loosely inside the louvre, and did not prevent the control rod from contacting the louvres. Furthermore it was not suitable for use with shutters having wooden components. U.S. Pat. No. 5,548,925, Aug. 27, 1996, issued to Shade-O-Matic Ltd, discloses a shutter formed of an extruded plastic material.

Louvres formed of hollow plastic extrusions were attached to a control rod utilizing connectors with two ends. The first end of each connector was rigidly attached to the control rod and the second end was rotatably inserted into a louvre. Thus movement of the control rod causes rotation of the louvres about the second ends of the connectors as the louvres are opened or closed. However, even in this system the control rod ends and the louvres were still in loose association with each other. Furthermore this system was not adaptable to wooden shutters, and was not entirely suitable for shutters made of aluminum.

U.S. Pat. No. 5,921,028, issued Jul. 13, 1999 issued to Shade-O-Matic Ltd. discloses a shutter formed of extruded plastic material. This system utilizes a hollow plastic louvre having end caps fitted into each end of the louvre. The end cap at one end is designed with a recess designed to be connected to the control rod. The control rod was fitted with connector stubs at intervals. The stubs could interconnect with the end cap recesses on the individual louvre blades. In this way the shutter was provided with a pull bar or control rod located along the side frame of the shutter. However although this system did eliminate the slack and did provide a defined pivot axis, the axis was located inwardly of the edges of the louvres. This system also was not adaptable to wooden shutters. It was also somewhat time consuming to assemble, and required some skill.

U.S. Pat. No. 6,041,547 issued Mar. 28, 2000 to Shade-O-Matic ltd, discloses a system somewhat similar to the '028 patent above. The louvres were hollow plastic, with end caps. One of the end caps was formed with an inwardly located recess for connection with a control bar. Connectors were rigidly attached to a control bar at intervals. The connectors linked with the recesses, inwardly of the edges of the louvres, so as to provide a pull bar controlling all the louvres, located down one edge of the side frame.

Again this system was not adaptable to wooden shutters, and was somewhat time consuming to assemble. Also since the pivot axis of each of the connectors was located inwardly of the louvres, it limited the freedom of movement of the control bar.

It would be desirable to provide a system for connecting the louvres with the control rod member that reduces the amount of free play between the control rod and the louvres and allows for smooth opening and closing of the louvres. Preferably it will not require recesses in the frame to accommodate the control rod. In addition it is desirable to provide a system that is easy to assemble, and is adaptable to shutters made of wood, or of plastic, or in some cases of metal such as aluminum.

BRIEF SUMMARY OF THE INVENTION

With a view to overcoming these various disadvantages the invention provides a shutter having a frame and rotatable louvres of the type having a control rod connected to the louvres for moving said louvres, and having a control rod extending normal to the louvres, spaced apart from the louvres, connector members on the louvres, having hinge formations extending outwardly remote from respective louvres, and having connector members for the control rod with hinge formations, and in which the hinge formations are engaged to provide a hinge connection between the louvres and the control rod, with hinge axes spaced away from the louvres, and locating the control rod at a distance from the louvres sufficient to permit the louvres to be fully closed by the control rod without the control rod contacting the louvres.

In general the invention provides a connector system which may be used on shutters having wooden components, on the one hand, or having plastic or aluminum components on the other hand. Certain modifications of the invention are especially adapted to certain types of plastic or aluminum shutters.

The hinge formations are usually some form of recess and mating pivot pin. However it is also possible to employ an integral plastic so-called "self-hinge". This is simply a portion of flexible plastic joining two members, so that they can both be formed in one piece. This may not be as durable for some applications, but could be an alternative for some lighter duty situations.

The invention further seeks to provide such a shutter and further having and wherein each said first connector member has a first embodiment stem portion for extending into a recess in a said louvre, and wherein each said second connector member has a second embodiment stem portion for extending into a recess in a said control member.

The invention further seeks to provide such a shutter and wherein one of said first and second hinge formations comprises a pin member, and the other of said first and second hinge formations comprises a recess shaped for receiving said pin member in pivotal relation.

The invention further seeks to provide such a shutter and including first and second stop portions on respective connector members, for limiting the insertion of said respective stem portions into respective said recesses.

The invention also provides a connector system for connecting a shutter control member with a plurality of shutter louvres of the type assembled in a shutter frame, for operating said louvres in unison between open and closed positions, and comprising;

a first connector member for one of a said louvre and said control member, a first fastening on said first connector member, for fastening to a said louvre and control member, a first hinge formation on said first connector member;

a second connector member for the other of said louvre and said control member;

a second fastening on said second connector member, for fastening in the other of said louvre and said control member, a second hinge formation on said second connector member, said first and second hinge portions being engageable with one another to provide a hinge connection between said louvre and said control member.

The invention further provides such a connector system and wherein one of said first and second hinge formations comprises a pin member, and the other of said first and second hinge formations comprises a recess shaped for receiving said pin member in pivotal relation.

The invention further provides such a connector system and including first and second stop portions on respective said connector members, for limiting the fastening of said respective connector members.

The invention further provides such a connector system and wherein said pin member extends from said first connector member substantially normal thereto, and wherein said recess extends transversely of said second connector member, whereby said pin member and said recess define an axis of rotation normal to said connector members.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

As explained above the invention finds its application in the construction of shutters having a frame, and louvres or blades pivotally mounted in the frame, and being rotatable between open and closed positions. For many years such shutters have been made of wood. The louvres were connected to a common control rod, and the control rod could be operated to swing the louvres open or closed. The connection between the louvres and the control rod was never totally satisfactory. It was somewhat primitive and resulted in a loose slack connection. As a result, in order to fully close the louvres the control rod had to be actually pushed up against the edges of the louvres. This in turn required that the upper and lower frame members had to be routed with recesses so as to permit the control rod to be pushed up against the edges of the louvres. Routing is an extra operation in manufacture and was undesirable. In addition where it was desired to make the shutters of extruded plastic, or hollow metal, routing was not possible.

Figure 1:
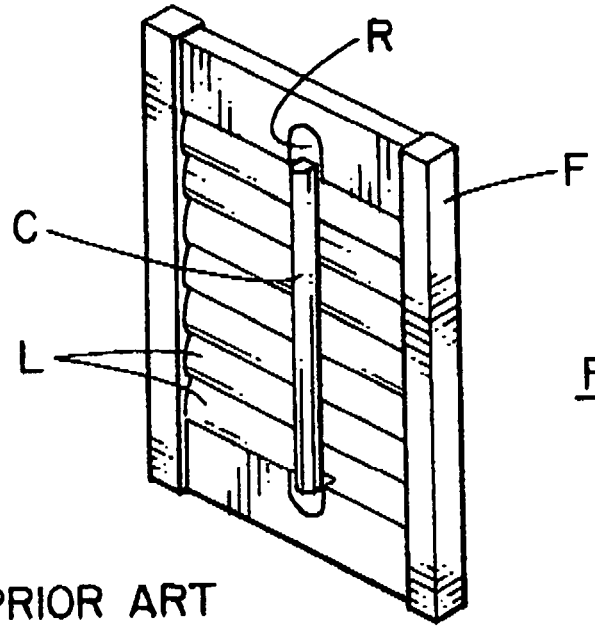
FIG. 1 is a perspective view of a typical prior art louvre shutter and labelled PRIOR ART and showing routed recesses in the frame.
Figure 2:
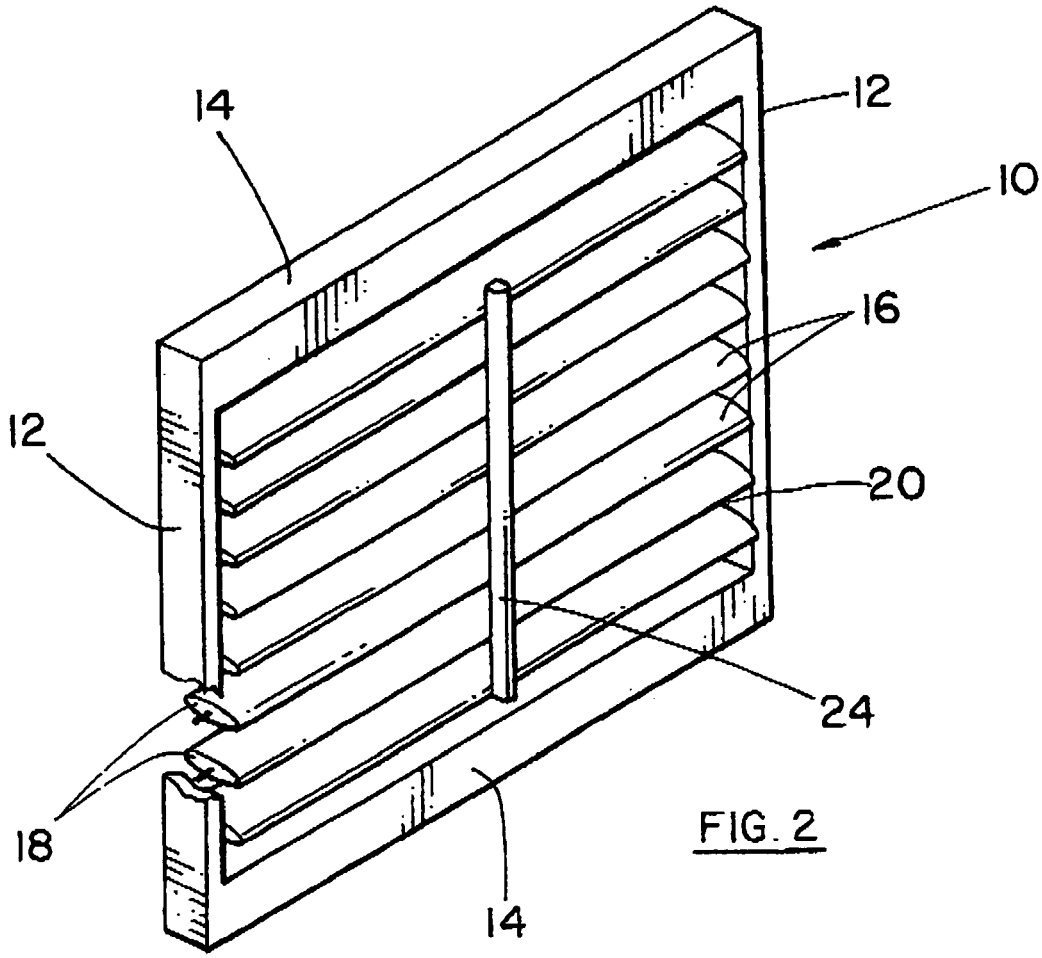
FIG. 2 is a perspective view of a louvre shutter, illustrating the invention.

A typical known form of shutter is shown in FIG. 1 marked "prior art". Frame (F) carries louvres (L). Control rod (C) connects with the louvres. Routed recesses (R) are made in the upper and lower frame members, to receive the upper and lower ends of the control rod. Typically in such earlier shutters the control rod (C) connects with the louvres (L) by means of crude links, usually in the form or wire staples (not shown) linked together and driven into the respective members. Such wire staple links are illustrated in U.S. Pat. No. 6,266,923 B1 referred to above.

FIGS. 2 to 5 show a shutter illustrating a first embodiment of the invention. Shutter (10) has frame sides (12) and frame top and bottom ends (14), assembled together to provide a rectangular frame. Frame top and bottom ends (14) are smooth members with no surface recesses formed therein. They are therefore suitable for manufacture from wood, without routing, or from extruded plastic or aluminum in some cases. Louvres (16) are horizontally mounted on the frame sides (12) so that the louvres (16) are pivotable between an open and closed position in a manner well known in that art and does not require further description. Each louvre (16) has an exterior edge (18) and an interior edge (20). The exterior edge (18), of louvres (16) is orientated such that when the louvre (16) is in the open position, the exterior edge (18) is toward the window or outside and the interior edge (20) is orientated towards the interior of the house. A pre-drilled louvre recess (22) is located on the interior edge (20) of each louvres (16). A control rod (24) is orientated substantially perpendicular relative to the louvres (16) and has pre-drilled rod recesses (26), at predetermined spacings. The spacings correspond to the spacings between each louvres (16).

Figure 3:
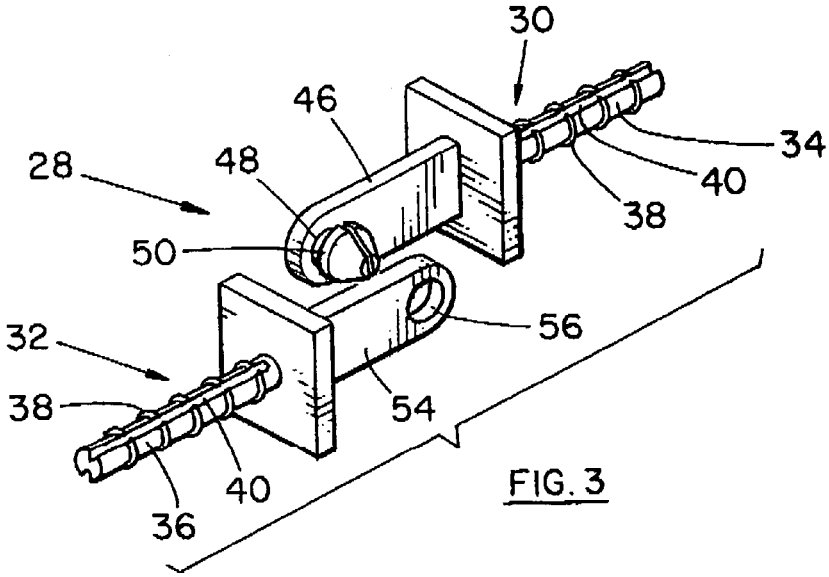
FIG. 3 is an exploded perspective view of the connection mechanisms illustrating the invention.
Figure 4:
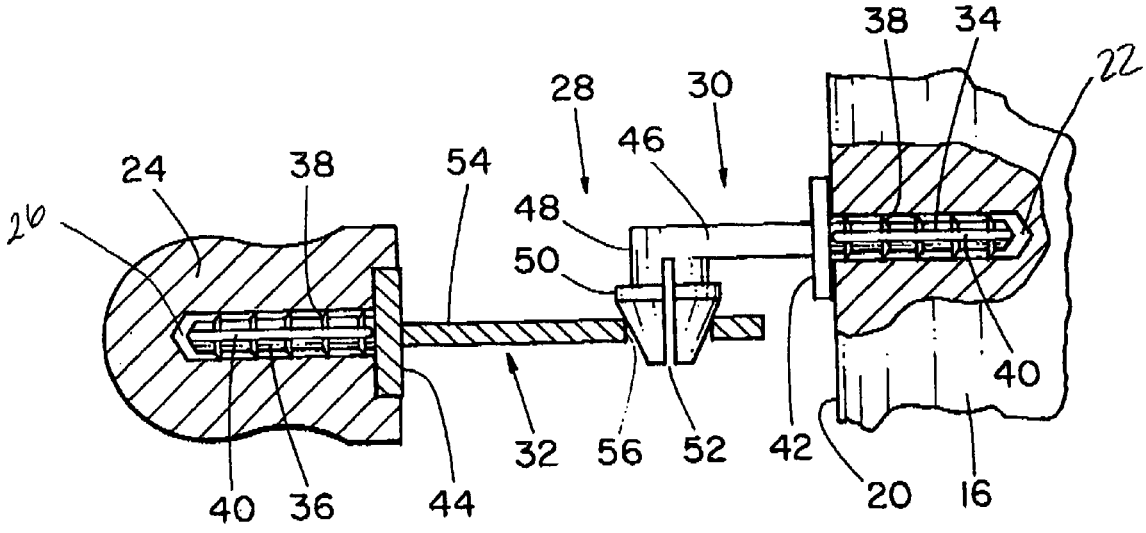
FIG. 4 is a partially exploded section along line 4-4 of FIG. 3.

Note that in FIGS. 3, and 4 the louvres (16) and shutter frame and control rod (24) are illustrated as being made of wood.

Figure 5:
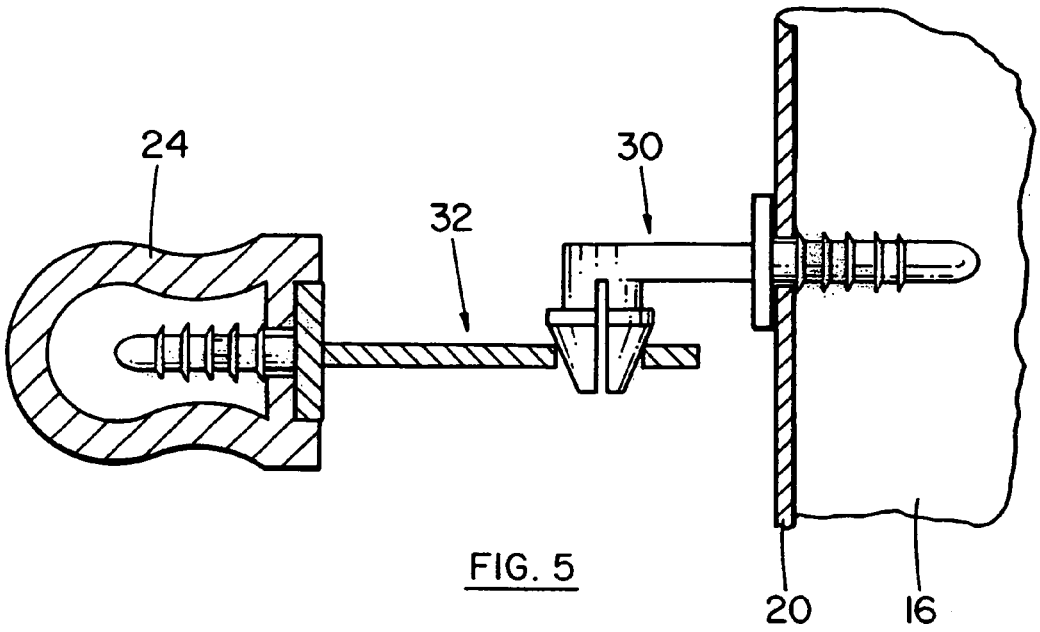
FIG. 5 is a partially exploded section corresponding to FIG. 4 showing another embodiment of the invention.
Figure 6:
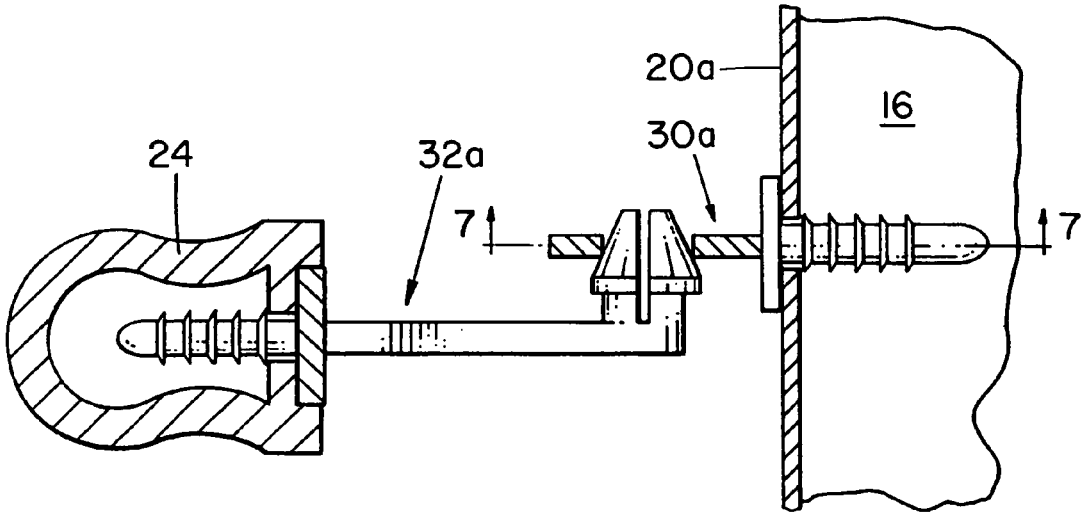
FIG. 6 is a partially exploded section corresponding to FIG. 5 showing another embodiment.
Figure 7:
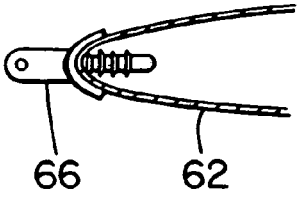
FIG. 7 is a section along line 7-7 of FIG. 6.

In the FIGS. 5, 6 and 7 embodiments the shutter frame and louvres (16) and control rod (24) are shown as being made of extruded hollow plastic. However the connection means is applicable to either type of shutter. Control rod (24) is connected to each louvres (16) by connection means (28). An illustration of one form of connection means (28) is clearly depicted in FIGS. 3 and 4. The connection means (28) comprises a first connection member (30) and a second connection member (32). First connection member (30) has first embodiment stem portion (34), or fastening, adapted to fit in a recess in one of the control rod (24) or a louvre (16). Second connection member (32) has second embodiment stem portion (36), or fastening, adapted to fit in a recess in the other of the control rod (24) and a louvre (16). Both stem portions have, in this case, frictional retention formations (38), which in this example are annular flanges formed around the stems at intervals. The flanges are flexible so as to permit insertion but restricting withdrawal. Both stem portions define shallow lengthwise grooves (40). These define discontinuities in each of the formations (38), which enable the formations (38) on the stem to be somewhat squeezed together upon insertion into a respective recess (22) or (26), and then to spring apart and lock the stem in position. Note that while stem portions are illustrated as the fastenings, in this embodiment, and they are convenient to make and use, other forms of fastenings are known and would serve the purpose. Each of the stem portions (34) and (36) are integrally formed with first and second stops (42) and (44) respectively. The first and second stops (42) and (44) are of a size larger than the louvre and rod recesses (22) and (26) so that the stops abut against the louvre and rod at predetermined depths.

Extending out from the first stop (42) is a first arm portion (46) which is formed at its free end with hinge formation, in this case a transverse male hinge pin (48), extending to one side of the arm portion normal thereto and having an abutment (50) formed on its end, defining a transverse slot (52). Extending out from the second stop (44) is a second arm portion (54) which is formed at its free end with hinge formation, in this case a transverse female recess (56) to receive hinge pin (48).

When assembled with the hinge pin (48) extending through the recess (56) the hinge pin (48) is rotatable in recess (56) and thus provides a form of hinge connection.

The recess (56) and hinge pin (48) define a predetermined axis of rotation indicated as (A), which is located in the space offset outwardly from the louvre (16) in the space between the interior edge (20) of the louvres (16), and the control rod (24). This achieves a space or separation between the control rod (24) and the louvres (16), which enables the louvres to be fully closed without contact between the louvres and the control rod.

Figure 11:
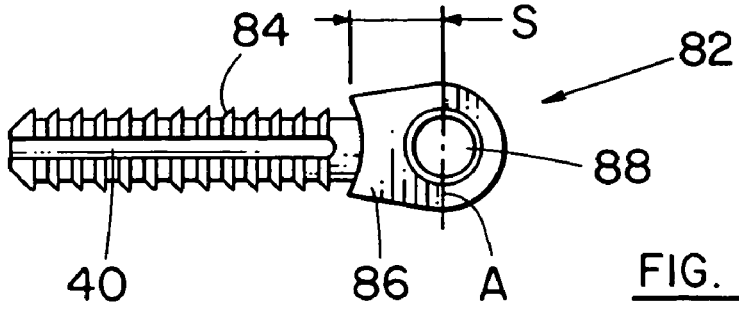
FIG. 11 is a side elevation of one component of an alternate form of the connector.
Figure 12:
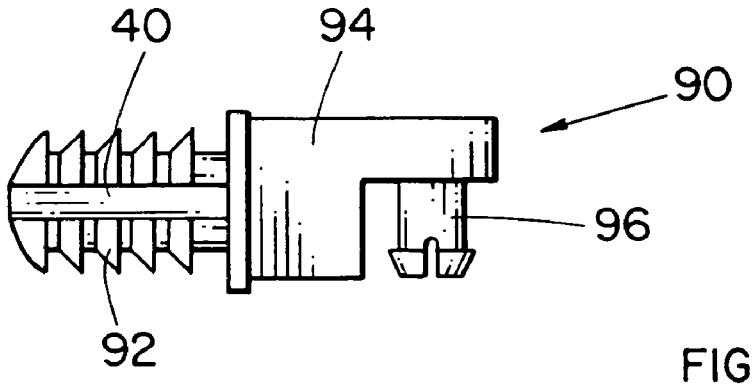
FIG. 12 is a side elevation of another component of the connector.

As shown in FIGS. 11 and 12 the offset of the axis from the louvre is about equal to the diameter of the recess (56) in arm (54). The spacing between the louvres (16) and the control rod (24) is about equal to between about 2 and 4 times the diameter of the recess (56).

The object is that rotation of the louvres will occur without there being any significant degree of slack between the two components of the connection means (28), and without contact of the louvres with the control rod. This is one example of an hinged connection but there could be any type of swingable or hinged connection known in the art, which provided a defined axis of rotation which was spaced away from the edge of the louvres by an amount sufficient to prevent contact between the louvres and the control rod.

Figure 13:
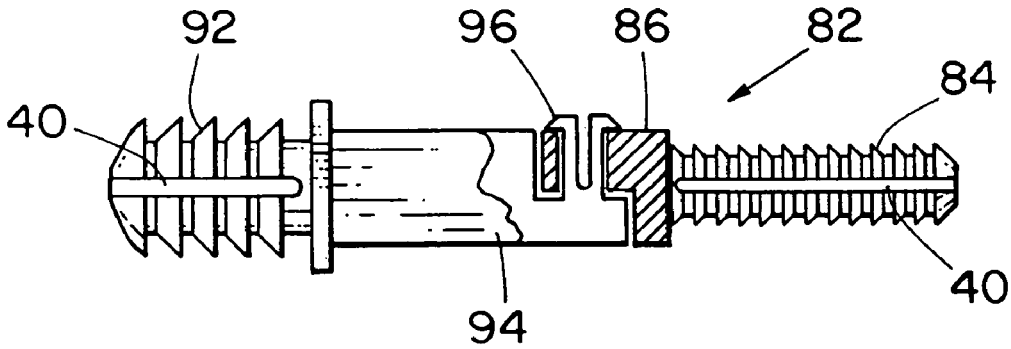
FIG. 13 is a top plan view of the FIGS. 10, 11, and 12 embodiment showing the two components assembled; and, FIG. 14 is a side elevation of a further embodiment.

The two components when assembled together will appear as shown in FIG. 13.

In this way when it is desired to close the louvres, the control rod can be either raised up, or drawn down. Due to the spacing (S) (FIG. 11), of the axis (A) away from the louvres and the separation of the control rod, the louvres can be drawn fully closed, without the control rod interfering with the top or bottom frame end (14). Thus no recess is required in either the top or bottom frame end. In addition all louvres will be maintained at the same angle of deflection set by the position of the control rod since there is no slack in the pivot axis of the connector means (28). The stem portions (34) and (36) of the connection members (30) and (32) may be threaded or employ retention rings or flanges (38), as shown in the illustrations, or any other means for retaining the stems in their recesses.

Thus the connection means (28) provide smoother operation of the control rod (24) during opening and closing the louvres (16). The slack in the connection that was a problem with previous designs is overcome by the formations of the hinge portions and the connection provided by them. Furthermore the frames of the entire shutter can be fabricated without forming recesses in the top and bottom frames. This both simplifies manufacture, provides a cleaner smoother appearance, and enables the use of extruded materials, such as hollow extruded plastic frames, which could not otherwise be used, if recesses were required.

It will be appreciated that FIGS. 2 to 6 illustrate one configuration of the first and second connector members (30) and (32). In this configuration the hinge connection on the first connector (30) is a male pin (48), and the hinge connection on the second connector (32) is a recess (56). It is possible to reverse this configuration without changing the invention.

FIGS. 6 and 7 illustrate such a reverse arrangement.

Figure 8:
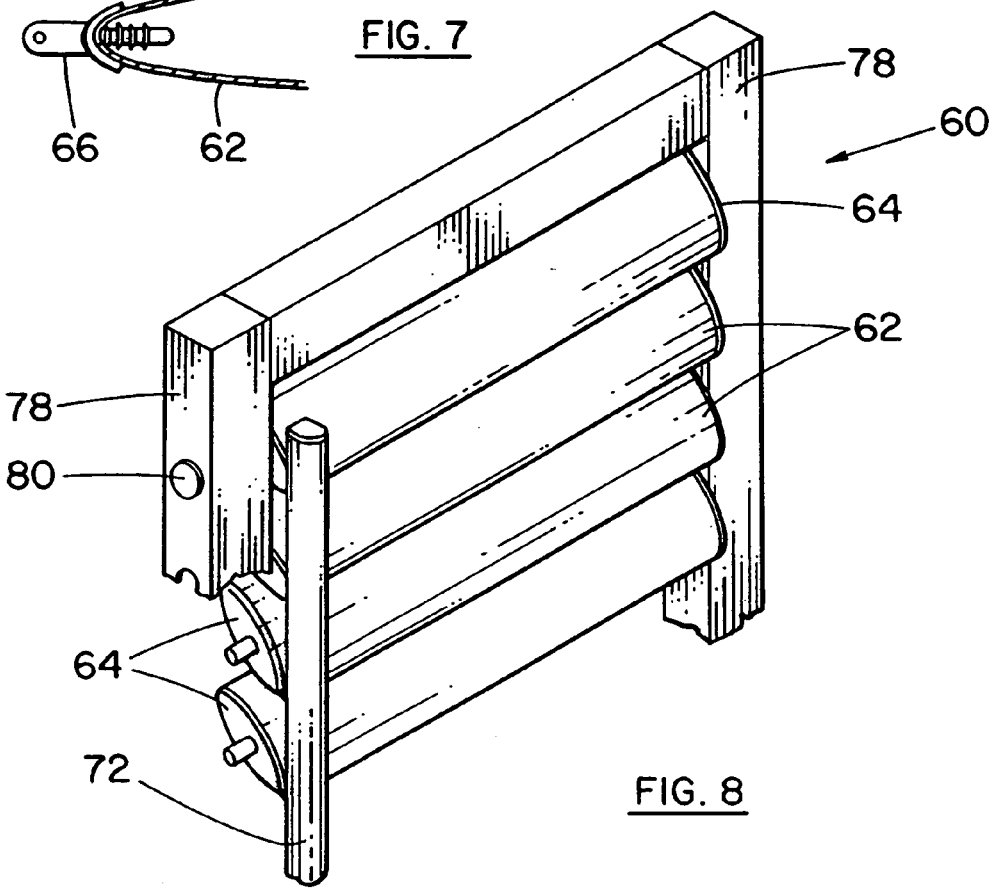
FIG. 8 is a perspective view partially cut away, of a shutter with hollow louvres fitted with end caps, and showing the control rod arranged down one side of the frame, illustrating another embodiment of the invention.
Figure 9:
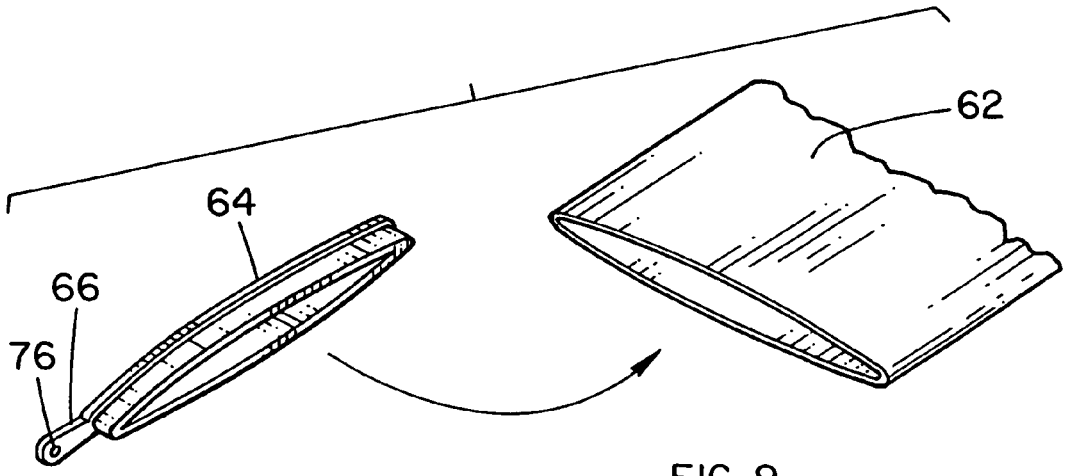
FIG. 9 is an exploded perspective view of one end of a hollow louvre of FIG. 8, and showing the end cap also in perspective.
Figure 10:
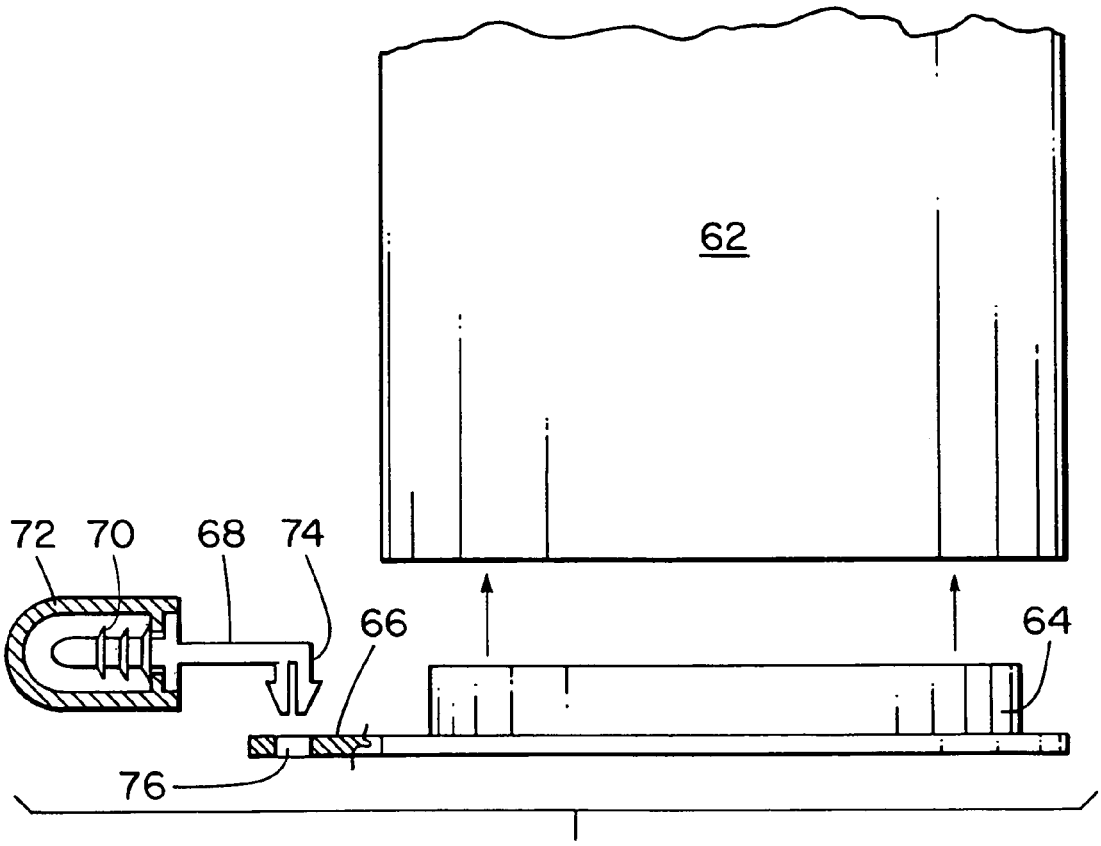
FIG. 10 is a top plan exploded plan view of one end of a hollow louvre with an end cap about to be inserted therein, and a control rod with a connector about to be connected to the end cap.

In a further embodiment, shown in FIGS. 8, 9, and 10, a different form of shutter (60) may incorporate hollow louvres (62) having end closures or caps (64). The louvres in this case are formed of hollow material typically being extruded plastic, though aluminum is another alternative.

In this embodiment a first hinge arm portion (66) is integrally formed with the end cap (64) and extends therefrom beyond the edge of the louvre (62). A complimentary second hinge arm portion (68) is formed on a stem (70) which is connected to the control rod (72). The two-hinge arm portions (66) and (68) are connectable together in much the same way as in the case of FIGS. 2 to 7. In this case however the male pin (74) is formed on stem (70) and the female recess (76) for the pin (74) is formed in arm (66) extending from end cap (64).

This therefor illustrates the reversal of the male and female hinge portions, as compared with FIGS. 3 and 4.

The control rod (72) in this embodiment is located down one side of the frame (78) instead of centrally of the louvres as in the FIGS. 2 to 6 embodiments.

If desired some form of frictional position setting device can be incorporated. Such a frictional device is illustrated in U.S. Pat. No. 6,041,547, and consists of spring washer system incorporated in the hollow side frame, which can be adjusted and set to provide the desired degree of friction required to hold the louvres in a desired setting.

Such a frictional setting device is indicated herein by the cap (80), FIG. 8, the details being substantially the same as in the aforesaid US patent and being omitted for the sake of clarity.

It will be seen that in the embodiment of FIGS. 8 to 10 the axis of the hinge is offset outwardly away from the louvre, by an amount equal to about the diameter of the recess (56) or (76), thus ensuring that the control rod does not contact the louvres, or require the formation of recesses in the frame.

FIGS. 11 and 12 illustrate the actual shape of a preferred embodiment of the two components of the connector system in a specific shutter.

Component (82) has a flanged stem (84), with a stop portion and an arm (86), formed with a recess (88). Component (90) has a flanged stem (92) and a stop portion and an arm (94) formed with a pin (96). The components are employed in the same way as already described above.

FIG. 13 shows the two components assembled.

The axis (A) of the hinge, and the spacing (S) from the louvre (not shown) are shown in FIG. 11.

Figure 14:
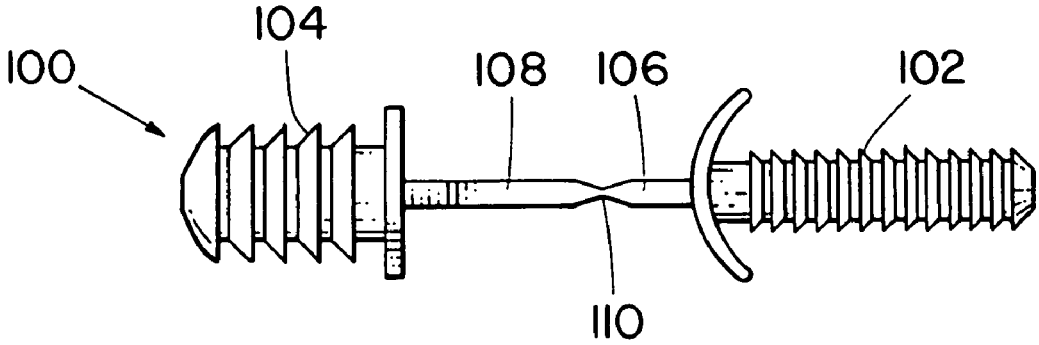

FIG. 14 illustrates an alternate embodiment, which may be used in certain cases.

In this embodiment there is a single hinge component (100) integrally moulded from one piece of plastic. It has two stems (102) ans (104), and two arms (106) and (108). Between arms (106) and (108) there is an integrally moulded "self-hinge" (110), which is flexible and provides a hinging action. The two stems are inserted in recesses in the louvre and the control rod as before. The self-hinge (110) allows the control rod to be moved up and down to swing the louvres between open and closed positions. This embodiment may have a somewhat shorter useful life, or may be suitable for lighter duty applications, than the pin and recess type of hinge, but this may be sufficient for many situations.

The foregoing is a description of a preferred embodiment of the invention which is given here by way of example only. The invention is not to be taken as limited to any of the specific features as described, but comprehends all such variations thereof as come within the scope of the appended claims.

| PARTS LIST | |
|---|---|
| 10 | shutter |
| 12 | frame |
| 14 | frame |
| 16 | louvre |
| 18 | exterior edge |
| 20 | interior edge |
| 22 | louvre recess |

-continued

| PARTS LIST | |
|---|---|
| 24 | control rod |
| 26 | rod recess |
| 28 | connection means |
| 30 | first connector |
| 32 | second connector |
| 34 | first stem |
| 36 | second stem |
| 38 | retention flanges |
| 40 | grooves |
| 42 | stop |
| 44 | stop |
| 46 | arm |
| 48 | hinge pin |
| 50 | abutment |
| 52 | slot |
| 54 | second arm |
| 56 | female recess |
| 60 | shutter |
| 62 | louvres |
| 64 | end caps |
| 66 | first hinge arm |
| 68 | second hinge arm |
| 70 | stem |
| 72 | control rod |
| 74 | male pin |
| 76 | recess |
| 78 | frame |
| 80 | cap |
| 82 | component |
| 84 | stem |
| 86 | arm |
| 88 | recess |
| 90 | component |
| 92 | stem |
| 94 | arm |
| 96 | pin |
| 100 | hinge component |
| 102 | stem |
| 104 | stem |
| 106 | arm |
| 108 | arm |
| 110 | self hinge |
| S | spacing |
| A | axis |

What is claimed is:

1. A shutter having a frame and a plurality of louvers, the plurality of louvers are rotatably mounted in the frame, the plurality of louvers moving in unison between an opened position and a closed position, the shutter having a control rod, the control rod extending perpendicular and vertically to the plurality of louvers, the shutter comprising:

(a) a plurality of first connection members mounted on the plurality of louvers having a plurality of first hinge formations extending outwardly from the plurality of louvers, wherein the plurality of first hinged formations have a plurality of pin members extending therefrom in a first direction that is substantially normal thereto; and (b) a plurality of second connection members mounted on the control rod having a plurality of second hinge formations extending outwardly from the control rod, wherein the plurality of second hinge formations have a first plurality of recesses for receiving the plurality of pin members in a pivotal relation, and wherein the plurality of pin members are engaged to the first plurality of recesses to provide a plurality of hinge connections between the plurality of louvers and the control rod, wherein the plurality of hinge connections define a predetermined axis of rotation spaced between the plurality of louvers and the control rod, wherein the predetermined axis of rotation is spaced further away from the control rod than the plurality of louvers, and wherein the control rod is located at a distance from the plurality of louvers sufficient to permit the plurality of louvers to be fully closed by the control rod without the control rod contacting the plurality of louvers.

2. The shutter of claim 1, wherein each of the plurality of first connection members has a first embedment stem portion for extending inwardly into a recess in the plurality of louvers, and wherein each of said plurality of second connection members has a second embedment stem portion for extending inwardly into a recess in the control rod.

3. The shutter of claim 2, further comprising a first stop portion on each of the plurality of first connection members and a second stop portion on each of the plurality of second connection members, wherein the first stop portion is larger than the recess in the control rod, wherein the second stop portion is larger than the recess in the plurality of louvers, wherein the first stop portion abuts the plurality of louvers, and wherein the second stop portion abuts the control rod.

4. The shutter of claim 2, wherein the first embedment stem portion and said second embedment stem portion each have slots longitudinally along said first and second embedment stem portions, and wherein said first embedment stem portion and said second embedment stem portion being squeezed to close the slots to facilitate insertion into said respective recesses.

5. The shutter of claim 4, wherein the first embedment stem portion and the second embedment stem portion have frictional formations for frictional retention of at least one of said first embedment stem portion and said second embedment stem portion.

6. The shutter of claim 1, further comprising an abutment having a slot formed on a first pin of the plurality of pin members whereby the abutment is squeezed to close said slot for insertion into a first one of the plurality of recesses.

7. The shudder of claim 1, wherein the predetermined axis of rotation is spaced further away from said control rod than the plurality of louvers.

8. The shutter of claim 7, wherein each of the plurality of first connection members each include an arm portion to maintain the predetermined axis of rotation spaced further away from the control rod than the plurality of louvers.

9. The shutter of claim 7, wherein each of said plurality of second connection members has a recess having a first diameter.

10. The shutter of claim 9, wherein the plurality of louvers are spaced from the control rod by a distance equal to between about two and about four times the first diameter.

11. The shutter of claim 9, wherein the plurality of louvers are spaced from the predetermined axis of rotation by a distance equal to about the first diameter.

12. The shutter of claim 1, wherein the plurality of first hinged formations is shorter than the plurality of second hinged formations.

13. The shutter of claim 1, wherein said each of the plurality of louvers has a first interior surface and a first exterior surface, wherein said control rod has a second interior surface and a second exterior surface, and wherein said each of the plurality of first connection members is mounted on the first interior surface.

14. The shutter of claim 13, wherein said each of the first plurality of recesses extend outwardly from the second exterior surface, wherein said each of the plurality of pin members is rotatably received by a respective one of the first plurality of recesses so that the plurality of louvers are maintained at substantially the same angle of deflection set by a position of said control rod, and wherein the plurality of first and second connection members inhibit lateral rotation of the control rod about a vertical length of the control rod.

15. A shutter having a plurality of rotatably mounted louvers moving between an open and a closed position, the shutter comprising:

(a) a frame having a plurality of side members, a top member, and a bottom member, the plurality of rotatably mounted louvers extending between the plurality of side members and being swingably mounted thereto;

(b) a control rod having an exterior surface and an interior surface, wherein the control rod extends perpendicularly and vertically with respect to the plurality of rotatably mounted louvers, and wherein the control rod is located centrally to the plurality of rotatably mounted lovers; and (c) a plurality of first connection members being mounted on the plurality of rotatably mounted louvers having a plurality of first hinged formations wherein the plurality of first hinged formations have a plurality of pin members extending outwardly therefrom in a first direction that is substantially normal thereto;

(d) a plurality of second connection members being mounted on the exterior side of the control rod, wherein the plurality of second connection members have a plurality of second hinge formations extending outwardly from the control rod, wherein the plurality of said pin members are connected to the plurality of second hinge formations at a predetermined axis of rotation, and wherein the predetermined axis of rotation is spaced away from said plurality of rotatably mounted louvers and spaced further away from the control rod than the plurality of rotatably mounted louvers.

16. A shutter having a frame and a plurality of louvers extending longitudinally thereof to present a spaced interior edge and a spaced exterior edge, the plurality of louvers being rotatably mounted in the frame, the plurality of louvers moving in unison between an opened position and a closed position, the shutter having a control rod, the control rod extending perpendicularly and vertically with respect to the plurality of louvers, the shutter comprising:

(a) a plurality of first connection members being mounted on the plurality of louvers, wherein the plurality of first connection members have a plurality of first hinged formations extending outwardly from an interior edge of the plurality of louvers;

(b) a plurality of second connection members being mounted on the control rod, wherein the plurality of second connection members have a plurality of second hinged formations extending outwardly from the control rod, wherein each of the plurality of first connection members has a first embedment stem portion extending inwardly into a recess in the plurality of louvers, wherein each of said plurality of second connection members has a second embedment stem portion extending inwardly into a recess in the control rod, wherein the plurality of first hinged formations are connected to the plurality of second hinged formations at a predetermined axis of rotation spaced beyond the plurality of louvers and are disposed between the interior edge of the plurality of louvers and the exterior surface of the control rod, and wherein the first and second connection members form a connection that inhibits lateral rotation of the control rod about a vertical length of the control rod.

17. The shutter of claim 16, further comprising:

a first portion on each of the plurality of first connection members;

a second stop portion on each of said plurality second connection members;

wherein said first stop portion is larger than the recess in the plurality of louvers, wherein said second stop portion is larger than the recess in the control rod, and wherein the first and second stop portions abut against each of said plurality of louvers and the control rod.

18. The shutter of claim 16, wherein said control rod does not contact the plurality of rotatably mounted louvers, and wherein the top member and the bottom member define a planar front surface and a planar rear surface, the planar front and rear surfaces being free of recesses.

* * * * *